US006645299B2

(12) United States Patent
Brown

(10) Patent No.: US 6,645,299 B2
(45) Date of Patent: Nov. 11, 2003

(54) METHOD AND ASSEMBLY FOR MASKING

(75) Inventor: Peter Martin Brown, Lebanon, OH (US)

(73) Assignee: General Electric Company, Schenectady, NY (US)

( * ) Notice: Subject to any disclaimer, the term of this patent is extended or adjusted under 35 U.S.C. 154(b) by 79 days.

(21) Appl. No.: 09/954,774

(22) Filed: Sep. 18, 2001

(65) Prior Publication Data

US 2003/0054104 A1 Mar. 20, 2003

(51) Int. Cl.[7] ..... B05C 13/00
(52) U.S. Cl. ..... 118/505; 118/504; 427/282
(58) Field of Search ..... 118/504, 505; 427/282

(56) References Cited

U.S. PATENT DOCUMENTS 4,822,108 A * 4/1989 Benhart ..... 301/36.1
5,207,794 A * 5/1993 Erdal ..... 277/346
5,301,415 A * 4/1994 Prinz et al. ..... 29/458
5,527,586 A * 6/1996 Schuler et al. ..... 428/164
5,632,529 A 5/1997 Wei
5,704,535 A * 1/1998 Thompson, Sr. ..... 228/39
5,786,028 A 7/1998 Cantwell
5,888,301 A * 3/1999 Jamieson ..... 118/500
5,902,647 A 5/1999 Venkataramani et al.
5,915,743 A 6/1999 Palma
5,916,638 A 6/1999 Zajchowski et al.
6,037,004 A 3/2000 Zajchowski et al.
6,060,117 A 5/2000 Pergande et al.
6,109,873 A 8/2000 Brooks et al.
6,146,489 A * 11/2000 Wirth ..... 156/280
6,273,676 B1 8/2001 Brooks et al.

* cited by examiner

*Primary Examiner*—J. A. Lorengo
*Assistant Examiner*—Michelle A Lazor
(74) *Attorney, Agent, or Firm*—V. G. Ramaswamy Sonnenschein Nath & Rosenthal LLP

(57) ABSTRACT

A mask assembly for protecting a portion of a workpiece from over spray while coating a preselected surface of the workpiece with thermal spray. The mask assembly includes a sheet sized and shaped for covering the portion of the workpiece which the assembly is intended to protect and a support plate selectively mountable over the sheet while the surface is coated with thermal spray. The mask assembly also includes a clamp mountable on the support plate for selectively attaching the support plate to the workpiece thereby clamping the support plate and sheet in position over the portion of the workpiece.

16 Claims, 3 Drawing Sheets

METHOD AND ASSEMBLY FOR MASKING

BACKGROUND OF THE INVENTION

The present invention relates generally to thermal spraying, and more particularly, to a method and assembly for masking a workpiece during thermal spraying to protect a portion of the workpiece from over spray.

Components are sometimes repaired using a thermal spray process to build up surfaces. Without taking steps to avoid over spray, the thermal spray also coats surfaces adjacent the surface intended to be coated. Not only can the coating degrade component performance, but processes used to remove over spray such as grit blasting can also degrade the component performance. For example, FIG. 1 illustrates a circular rabbet surface 10 of a high pressure turbine forward air seal, generally designated by 12, having a radius 14 measured from a centerline 16 of the seal. If the rabbet surface 10 is machined to a radius 14 less than engineering specifications, it may be repaired by applying a high velocity oxy fuel (HVOF) thermal spray. However, a fillet 18 immediately adjacent the rabbet surface 10 is highly stressed and cannot withstand degradation associated with over spray. Accordingly, the fillet 18 must be masked to protect it from over spray while the rabbet surface 10 is coated with thermal spray.

Although masking tapes may be used with lower velocity air plasma spray coating processes, these tapes cannot withstand the forces exerted by the HVOF thermal spray process. High temperature silicone putties designed for HVOF coating processes must be trimmed so they are positioned accurately enough to allow the coating to build up the rabbet surface 10 without allowing coating in the fillet 18. However, the trimming process may damage the component. Although thick one-piece metal masks (i.e., masks having a thickness greater than 0.1 inch) are often used to mask during HVOF thermal spray, components such as the forward air seal 12 have shapes which prevent the use of these masks because the masks obstruct the thermal spray from reaching the rabbet surface 10.

SUMMARY OF THE INVENTION

Among the several features of the present invention may be noted the provision of a mask assembly for protecting a portion of a workpiece from over spray while coating a preselected surface of the workpiece with thermal spray. The mask assembly comprises a sheet sized and shaped for covering the portion of the workpiece which the assembly is intended to protect and a support plate selectively mountable over the sheet while the surface is coated with thermal spray. Further, the mask assembly comprises a clamp mountable on the support plate for selectively attaching the support plate to the workpiece thereby clamping the support plate and sheet in position over the portion of the workpiece.

In another aspect, the present invention includes a method of masking a workpiece to protect a portion of the workpiece from over spray while coating a preselected surface of the workpiece with thermal spray. The method comprises the steps of selecting a sheet sized and shaped for covering the portion of the workpiece which the assembly is intended to protect and aligning the sheet with the portion of the workpiece so that an end of the sheet defines a boundary of the preselected surface of the workpiece. In addition, the method includes clamping the sheet to the portion of the workpiece to prevent the sheet from moving while coating the surface of the workpiece with thermal spray.

In yet another aspect, the present invention includes a mask assembly for protecting a portion of a workpiece from over spray while coating a preselected surface of the workpiece with thermal spray. The mask assembly comprises a sheet having a thickness of less than about 0.10 inch. The sheet is sized and shaped for covering the portion of the workpiece. Further, the mask assembly comprises a clamp for selectively clamping the sheet to the workpiece in position over the portion of the workpiece.

Other features of the present invention will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENT

Figure 1:
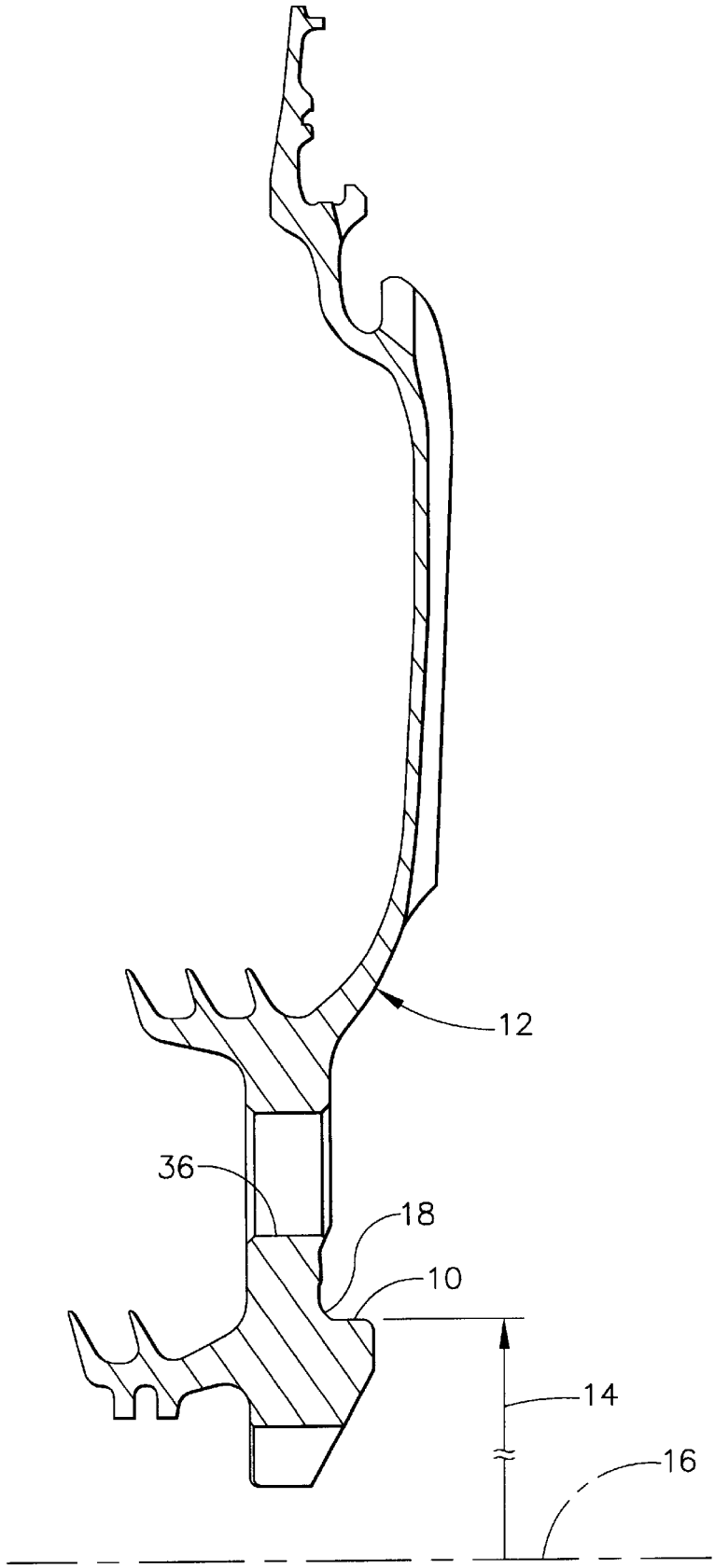
FIG. 1 is a vertical cross section of a workpiece with which the mask assembly of the present invention is used.
Figure 2:
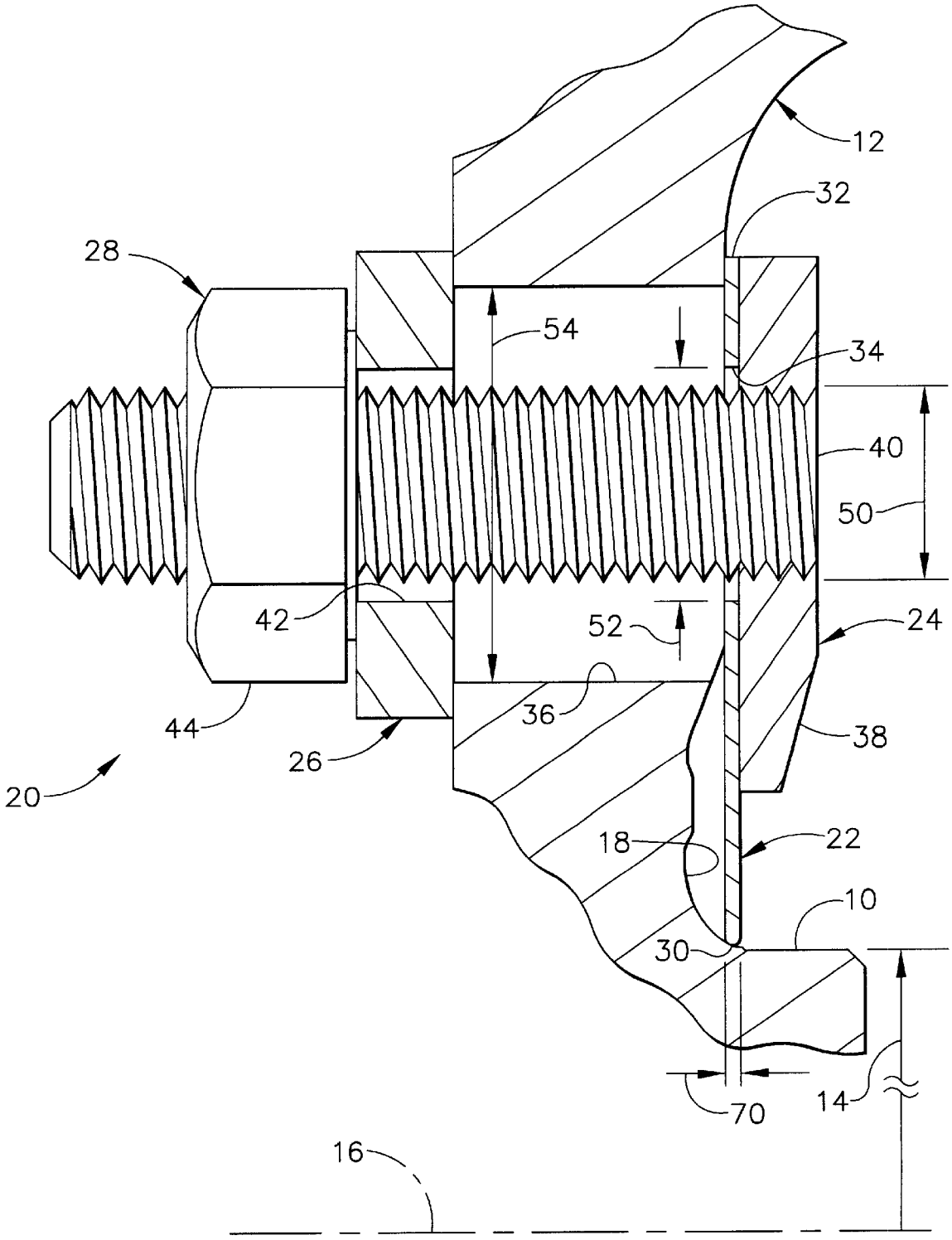
FIG. 2 is a detail of the workpiece having the mask assembly installed.

Referring now to the drawings and in particular to FIG. 2, a mask assembly of the present invention is designated in its entirety by the reference number 20. The mask assembly 20 is used for protecting a portion of a workpiece such as a fillet 18 of a high pressure turbine forward air seal 12 from over spray while coating a preselected surface of the workpiece such as a circular rabbet surface 10 with thermal spray.

In one embodiment, the mask assembly 20 comprises a sheet, a support plate, a backing plate and a clamp, generally designated by 22, 24, 26 and 28, respectively. The sheet 22 is sized and shaped for covering the portion of the workpiece which the assembly 20 is intended to protect. For example, a sheet 22 sized and shaped for covering the fillet 18 of the high pressure turbine forward air seal 12 would have a circular inner end 30 having a radius corresponding to the rabbet radius 14 so the inner end of the sheet would define one boundary of the surface of the air seal being coated. The inner end 30 is rounded as illustrated in FIG. 2 to avoid damaging the air seal 12. The sheet 22 also has an outer end 32 having a size and shape which are not critical because the outer end is spaced from the surface of the workpiece being sprayed. In one embodiment, the outer end 32 is also circular and has a radius large enough to eliminate the potential for over spray to contact the workpiece outside the sheet 22 (e.g., about one inch larger than the inner radius).

Figure 3:
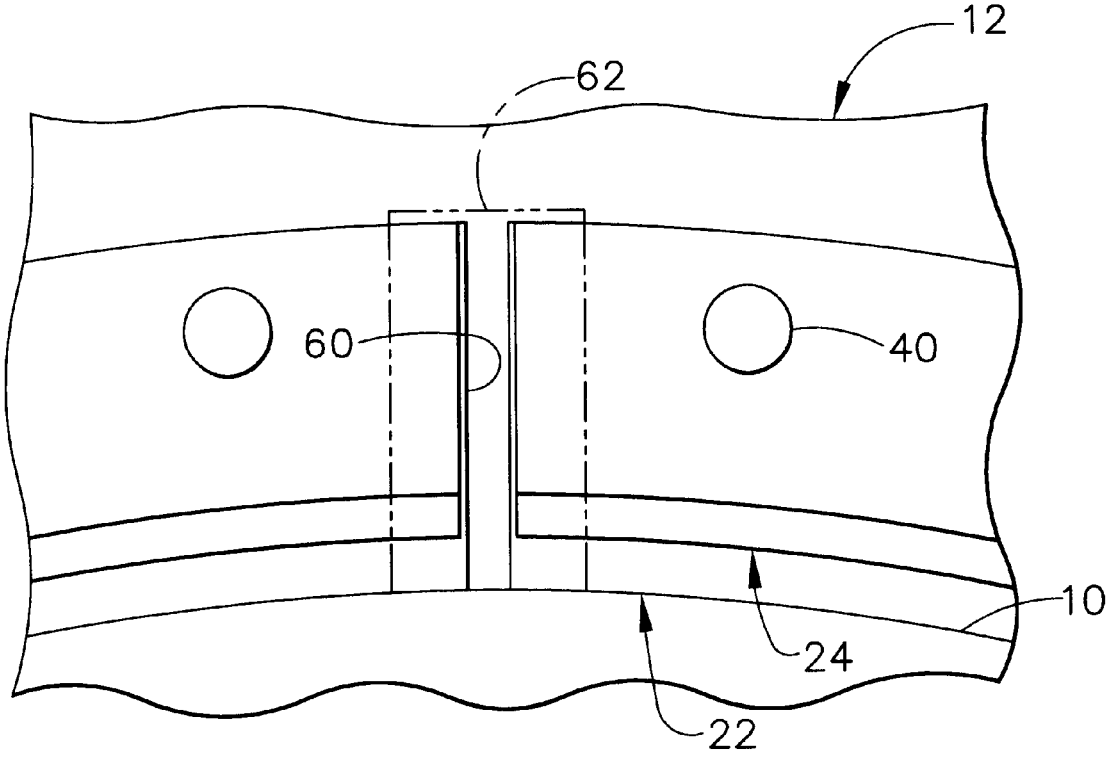
FIG. 3 is a rear elevation of the workpiece having the mask assembly installed.

Although the sheet 22 may be formed in one piece without departing from the scope of the present invention, in one embodiment the sheet is segmented (e.g., in four segments) as illustrated in FIG. 3 for covering corresponding segments of the air seal 12. Each segment of the sheet 22 includes a plurality of holes 34 (e.g., six holes) positioned for alignment with bolt holes 36 extending through the air seal 12. These holes 34 are used to fasten the segments of the sheet 22 to the air seal 12 as will be explained in greater detail below.

As further illustrated in FIG. 2, the support plate 24 is selectively mountable over the sheet 22 while the surface 10 is coated with thermal spray to support the sheet. The support plate 24 is spaced from the end 30 when mounted over the sheet 22 so the support plate does not obstruct the surface 10 of the air seal 12 during spraying. Further, the support plate 24 includes a relieved edge 38 to provide access to the surface 10 of the air seal 12 so the support plate does not obstruct the surface while the surface is coated with thermal spray. As will be appreciated by those skilled in the art, the support plate 24 supports and protects the sheet 22 so that the sheet may be made from thinner material.

The clamp 28 is mountable on the support plate 24 for selectively attaching the support plate to the air seal 12. Thus, the clamp 28 clamps the support plate 24 and sheet 22 in position over the portion of the workpiece being protected from over spray. Although the clamp 28 may have other configurations without departing from the scope of the present invention, in one embodiment the clamp 28 includes a stud 40 mounted on the support plate 24. The stud 40 is sized and positioned on the support plate 24 to be received within the bolt holes 34, 36 extending through the sheet 22 and the air seal 12, as well as bolt holes 42 extending through the backing plate 28 to fasten the assembly 20 to the air seal. A nut 44 is threaded on the stud 40 to hold the assembly 20 in position on the air seal 12. As illustrated in FIG. 2, the stud 40 has an outer diameter 50 smaller than a diameter 52 of the bolt hole 34 in the sheet 22 and a diameter 54 of the bolt hole 36 in the air seal 12, thus providing clearance so the position of the sheet can be adjusted until the inner end 30 touches the air seal. As will be appreciated by those skilled in the art, the backing plate 26 protects the air seal 12 from damage as the nut 44 is tightened.

As illustrated in FIG. 3, when the sheet segments 22 are assembled, they are spaced by end gaps 60 extending radially with respect to the air seal 12. High temperature masking tape 62 (shown in phantom) may be used to cover the end gaps 60 between the segments 22 to protect the air seal 12 from over spray. Although other masking tapes may be used without departing from the scope of the present invention, in one embodiment the masking tape is FLUORGLAS7 2905-7 tape available from Furon Company Corporation of Laguna Niguel, Calif. FLUORGLAS is a U.S. federally registered trademark owned by Furon Co. Corp. This masking tape has been found to have sufficient durability to withstand HVOF thermal spray over the small areas required to cover the end gaps 60. Further, those skilled in the art will appreciate that because the gaps 60 are very narrow (e.g., 0.040 inch) positioning and/or trimming the tape to fit the gaps is fairly easy to accomplish without damaging the air seal 12 even with minimal operator skill.

To use the masking assembly, the sheet 22 is formed using conventional manufacturing techniques such as electrical discharge machining so it is sized and shaped for covering the portion of the workpiece which the assembly is intended to protect. As illustrated in FIG. 2, the sheet 22 is formed from raw sheet material having a preselected thickness 70 (e.g., 0.020 inch) so the assembly 10 obstructs only the portion of the workpiece it is intended to protect without obstructing the portion of the workpiece intended to be coated. Although other materials may be used without departing from the scope of the present invention, in one embodiment the raw sheet material used to form the sheet is a cold rolled steel having a thickness less than about 0.100 inch. Other thicknesses may be used without departing from the scope of the present invention provided the sheet material is thick enough to withstand thermal spray.

Once the sheet 22 is formed to the appropriate size and shape, it is aligned with the fillet 18 of the air seal 12 so that the inner end 30 of the sheet defines a boundary of the surface 10 being coated. The studs 40 of the clamp 28 are inserted through the holes 34 in the sheet 22, and the backing plate 26 is installed over the ends of the studs. The nuts 44 are threaded onto the studs 40 and tightened to clamp the sheet 22 over the fillet 18 to prevent the sheet from moving while coating the surface 10 of the air seal 12 with thermal spray. Once the assembly 20 is so installed, the air seal surface 10 may be coated with thermal spray using conventional processes. After the air seal 12 is sprayed, the assembly 20 may be removed and reused. If the sheet 22 becomes damaged, it can easily and inexpensively be replaced by forming a new one. Because the other components of the assembly 20 are made from heavier stock, the are less susceptible to damage.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above constructions without departing from the scope of the invention, it is intended that all matter contained in the above description or shown in the accompanying drawings shall be interpreted as illustrative and not in a limiting sense.

What is claimed is:

1. A mask assembly for protecting a portion of a workpiece from over spray while coating a preselected surface of the workpiece with thermal spray, said mask assembly comprising:

an annular sheet formed in segments for covering corresponding segments of the annular workpiece, said sheet being sized and shaped for covering the portion of the workpiece which the assembly is intended to protect;

a support plate selectively mountable over the sheet while the surface is coated with thermal spray; and a damp mountable on the support plate for selectively attaching the support plate to the workpiece thereby clamping the support plate and sheet in position over the portion of the workpiece.

2. A mask assembly as set forth in claim 1 wherein the sheet includes an end at least partially defining a boundary of the preselected surface of the workpiece and the support plate is spaced from the end when mounted over the sheet so that the preselected surface of the workpiece is unobstructed by the support plate during spraying.

3. A mask assembly as set forth in claim 2 wherein the support plate includes a relieved edge to provide access to the preselected surface of the workpiece so the preselected surface is unobstructed by the support plate while the surface is coated with thermal spray.

4. A mask assembly as set forth in claim 1 further comprising a backing plate mountable between the nut and the workpiece for protecting the workpiece from damage.

5. A mask assembly as set forth in claim 1 wherein the workpiece and the sheet are annular.

6. A mask assembly as set forth in claim 1 wherein the sheet segments are spaced by end gaps extending radially along the portion of the workpiece, and the assembly further comprises masking tape for covering the end gaps between the segments to protect the workpiece from over spray.

7. A mask assembly as set forth in claim 1 wherein the portion of the workpiece which the assembly is intended to protect includes a fillet adjacent a outward facing rabbet diameter, and the sheet includes an inner end having a diameter corresponding to the rabbet diameter.

8. A mask assembly as set forth in claim 7 wherein the inner end of the sheet is rounded to avoid damaging the workpiece.

9. A mask assembly as set forth in claim 7 in combination with the workpiece and a conventional thermal spray apparatus for coating the preselected surface of the workpiece.

10. A mask assembly as set forth in claim 1 in combination with the workpiece and a conventional thermal spray apparatus for coating the preselected surface of the workpiece.

11. A mask assembly for protecting a portion of an annular workpiece from over spray while coating a preselected surface of the workpiece with thermal spray, said mask assembly comprising:

an annular sheet having a thickness of less than about 0.10 inch, the sheet being sized and shaped for covering the portion of the workpiece; and a clamp for selectively clamping the sheet to the workpiece in position over the portion of the workpiece.

12. A mask assembly as set forth in claim 11 wherein the sheet has a thickness of about 0.02 inch.

13. A mask assembly as set forth in claim 11 wherein the workplace includes a hole spaced from the preselected surface of the workpiece, and the clamp comprises a fastener for receipt within the hole in the workpiece.

14. A mask assembly as set forth in claim 11 wherein the sheet is formed in segments for covering corresponding segments of the annular workpiece.

15. A mask assembly as set forth in claim 14 wherein the sheet segments are spaced by end gaps extending radially along the portion of the workpiece, and the assembly further comprises masking tape for covering the end gaps between the segments to protect the workpiece from over spray.

16. A mask assembly as set forth in claim 11 further comprising a support plate selectively mountable over the sheet while the surface is coated with thermal spray.

* * * * *